US009273854B2

(12) United States Patent
Lee et al.

(10) Patent No.: US 9,273,854 B2
(45) Date of Patent: Mar. 1, 2016

(54) WIRELESS TRANSMISSION DEVICE

(71) Applicants: Ting Yan Lee, Guangdong (CN); Chun Sang Ma, Guangdong (CN)

(72) Inventors: Ting Yan Lee, Guangdong (CN); Chun Sang Ma, Guangdong (CN)

(73) Assignees: Ting Yan Lee, Futian, Shenzhen, Guangdong (CN); Chun Sang Ma, Futian, Shenzhen, Guangdong (CN)

( * ) Notice: Subject to any disclaimer, the term of this patent is extended or adjusted under 35 U.S.C. 154(b) by 464 days.

(21) Appl. No.: 13/726,198

(22) Filed: Dec. 23, 2012

(65) Prior Publication Data

US 2013/0322098 A1 Dec. 5, 2013

(30) Foreign Application Priority Data

Jun. 4, 2012 (CN) ..... 2012 2 0259649 U

(51) Int. Cl.
*F21V 21/14* (2006.01)
*H05B 37/02* (2006.01)

(52) U.S. Cl.
CPC ..... *F21V 21/14* (2013.01); *H05B 37/0272* (2013.01)

(58) Field of Classification Search
CPC ..... G06Q 30/0267; G06Q 30/0241; G06Q 30/0277; H04W 4/208; H04M 3/4878; H04M 2250/16; H04M 2207/18; H04M 11/007; H04M 1/0225; H04N 21/4126; H04N 21/00; H04N 21/41407; H04N 21/43637; H04N 21/6131; H04N 21/81; H04N 21/4122; H04N 1/00307; G06F 1/1698; G06F 2200/1614; G06F 2200/1637; G06F 2203/04802; G09G 2370/16; G09G 2340/14; G09G 2354/00; G02F 1/133753
See application file for complete search history.

(56) References Cited

U.S. PATENT DOCUMENTS

2004/0109063 A1* 6/2004 Kusaka et al. ..... 348/207.1
2010/0328496 A1* 12/2010 Pozniansky et al. ... G06Q 30/02 348/231.99

FOREIGN PATENT DOCUMENTS

CN 1428729 A 7/2003
CN 1848117 A 10/2006

(Continued)

OTHER PUBLICATIONS

Nikon releases the Wireless Mobile Adapter WU-1a, which enables simple sharing of photos captured with a digital-SLR camera with smart devices, Apr. 19, 2012, downloaded from http://www.nikon.com/news/2012/0419_wireless_mobile_adapter_02.htm on Mar. 19, 2015.*

(Continued)

*Primary Examiner* — Haixia Du
(74) *Attorney, Agent, or Firm* — Winston Hsu; Scott Margo

(57) ABSTRACT

A wireless transmission device, arranged inside a display object or connected with the display object, includes a power supply interface, an initialization setting button, a wireless transmission unit, a processing unit, and a storage unit. The input end of the power supply interface is connected with the power supply end of the display object, the output end of the power supply interface is connected with the wireless transmission unit and the processing unit respectively, and the initialization setting button and the storage unit are connected with the processing unit respectively. A unique identification assigned to the display object is stored in the storage unit. Initialization setting of the wireless transmission device is implemented by pressing the initialization setting button, and the processing unit transmits out the identification, orientation, and/or predetermined viewable angle of the display object constantly or regularly via the wireless transmission unit.

5 Claims, 1 Drawing Sheet

(56) References Cited

FOREIGN PATENT DOCUMENTS

| | | | |
|---|---|---|---|
| CN | 101207801 | A | 6/2008 |
| CN | 101236716 | A | 8/2008 |
| CN | 101350163 | A | 1/2009 |
| CN | 101807278 | A | 8/2010 |

OTHER PUBLICATIONS

Nikon Wireless Mobile Adapter WU-1a User's Manual, Apr. 1, 2012, downloaded from http://www.shuttersnitch.com/downloads/manuals/nikon/WU-1a.pdf on Mar. 19, 2015.*

* cited by examiner

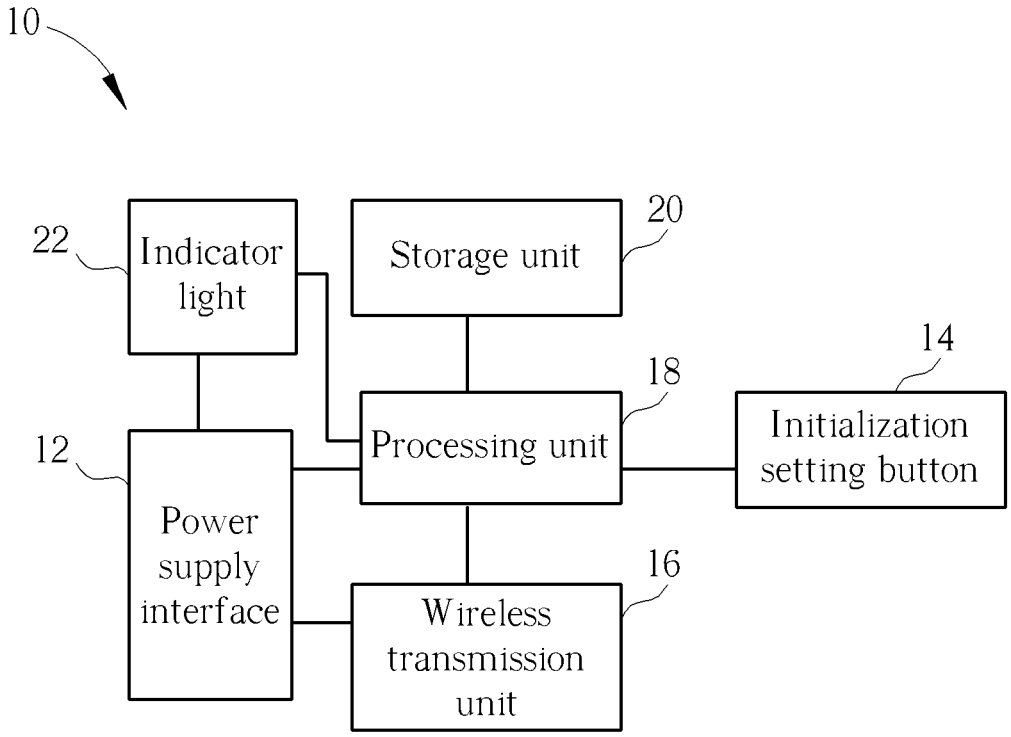
10
22
Indicator light
Storage unit
20
14
18
Initialization setting button
12
Processing unit
Power supply interface
16
Wireless transmission unit

WIRELESS TRANSMISSION DEVICE

BACKGROUND OF THE INVENTION

1. Field of the Invention

The utility model relates to the technical field of wireless communication, and particularly to a wireless transmission device.

2. Description of the Prior Art

Nowadays, people's lives have been filled with advertisements in various forms: posters on bus stop signs, television advertisements, outdoor big-screen advertisements, building advertisements, subway advertising machines, and the like. However, advertisers and investors are unaware of how much advertising revenue can be actually attained from advertisements that easily cost hundreds of thousands and even millions of dollars every month, how many people pay attentions to these advertisements, and if the public is interested in these advertisements.

In addition, with the continuous development of advertising technology, more and more advertisement developers have noted the above problems and have tried in different ways to achieve the interaction between advertising machines and advertisement receivers, e.g. touch-interaction type advertising machines, inquiry machines, and other machines that are poplar at present, and these machines are provided for the purpose of collecting and counting the number and personal information of advertisement receivers to further achieve interaction. However, interaction can be realized only in a one-to-one (one advertising machine can be operated only by one person at a time) mode no matter which way is adopted. Moreover, operation of the advertising machine can be performed only at a short distance, which reduces the utilization efficiency of the advertising machine.

SUMMARY OF THE INVENTION

The utility model provides a wireless transmission device, which is installed on or connected to an existing display object so that modification, installation, and setting for the existing display object can be achieved in a relatively simple way, thus saving investment cost.

The technical proposal below is adopted in the utility model: a wireless transmission device is arranged inside a display object or connected with the display object, and includes a power supply interface, an initialization setting button, a wireless transmission unit, a processing unit, and a storage unit;

the input end of the power supply interface is connected with the power supply end of the display object, the output end of the power supply interface is connected with the wireless transmission unit and the processing unit respectively, and the initialization setting button and the storage unit are connected with the processing unit respectively;

a unique identification assigned to the display object is stored in the storage unit; an initialization signal is input to the processing unit by pressing the initialization setting button, the processing unit communicates with a mobile terminal via the wireless transmission unit to set the orientation and/or predetermined viewable angle of the display object and store the orientation and/or the predetermined viewable angle in the storage unit respectively; and the processing unit transmits out the identification, orientation and/or predetermined viewable angle of the display object regularly via the wireless transmission unit.

The wireless transmission device of the utility model can be directly installed on or connected to display objects such as an advertising machine. Initialization settings, including the setting for the orientation and/or the predetermined viewable angle of the display object, can be realized only by pressing the initialization setting button after the wireless transmission device is installed on or connected to the display object. Afterwards, the wireless transmission device regularly transmits a wireless signal containing the identification, the orientation, and/or the predetermined viewable angle, and a mobile terminal can acquire the identification, the orientation, and/or the predetermined viewable angle after sensing the wireless signal. Thus data information displayed on the display object or data information relevant to the displayed data information can be acquired in accordance with the identification and accurate positioning of the display object can be accomplished in accordance with the orientation and/or the predetermined viewable angle. It can be seen that only the wireless transmission device needs to be installed on or connected to the existing display object during modification for the existing display object, and both initialization setting and installation are relatively simple, thus saving investment cost.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The FIGURE is a functional block diagram of the wireless transmission device of the utility model in one embodiment.

DETAILED DESCRIPTION

Detailed description is made below to the embodiments of the utility model with reference to the drawings.

A wireless transmission device 10 of the utility model is arranged inside a display object or connected with the display object, and comprises, as shown in the FIGURE, a power supply interface 12, an initialization setting button 14, a wireless transmission unit 16, a processing unit 18, and a storage unit 20. The display object may be a visible object like an advertising machine, an advertising screen or a display screen.

The input end of the power supply interface 12 is connected with the power supply end of the display object, the output end of the power supply interface 12 is connected with the wireless transmission unit 16 and the processing unit 18 respectively, and the initialization setting button 14 and the storage unit 20 are connected with the processing unit 18 respectively.

A unique identification assigned to the display object is stored in the storage unit 20, and a unique identification is assigned to every display object in advance in order to distinguish the display objects. Initialization setting for the display object can be achieved after the wireless transmission device 10 is installed on or connected to the display object, where an initialization signal is input to the processing unit 18 by pressing the initialization setting button 14, and the processing unit 18 communicates with a mobile terminal via the wireless transmission unit 16 to set the orientation and/or predetermined viewable angle of the display object and store the orientation and/or the predetermined viewable angle in the storage unit 20 respectively. The processing unit 18 transmits out the identification, orientation, and/or predetermined viewable angle of the display object regularly via the wireless transmission unit 16. When the wireless transmission unit 16 communicates with the mobile terminal, the mobile terminal can sense the orientation of the display object and sends the orientation to the processing unit 18, and the predetermined viewable angle can be set in consideration of actual road conditions or the orientation of the display object.

The mobile terminal can acquire the identification, the orientation, and/or the predetermined viewable angle after sensing the wireless signal transmitted by the wireless transmission device 10. Thus data information displayed on the display object or data information relevant to the displayed data information can be acquired from a data storage unit 20 in accordance with the identification, wherein the relevant data information may be more detailed information of the display object. The data information stored in the data storage unit 20 maybe videos, website links, words, pictures, advertisement information, coupons or movie tickets, etc., the data information displayed on each display object or the relevant data information can be stored in the data storage unit 20 and corresponds to the identification of each display object, and the data information stored is updated by the data storage unit 20 in real time.

After acquiring the orientation and/or the predetermined viewable angle of the display object, the mobile terminal forms a sector area at the predetermined viewable angle spreading to the left and right sides by taking the orientation of the mobile terminal as a central axis, wherein the sector area serves as a sensing area of the mobile terminal, and the mobile terminal then determines whether the display object is within the sensing area of the mobile terminal according to the orientation of the display object. If so, the mobile terminal acquires the data information from the data storage unit 20 according to the identification of the display object. If not, no data information is acquired any more. Therefore, accurate positioning of the display object can be accomplished.

The data storage unit 20 maybe a remote server, and the mobile terminal can acquire the data information on the server by means of wireless access to the Internet or any form of network. The data storage unit 20 may also be a local memory, and the mobile terminal can acquire the data information on the memory by means of wireless data transmission. The mobile terminal may be a mobile device such as a mobile phone, and the wireless transmission unit 16 and the wireless transmission device 10 may be Bluetooth modules or WIFI modules, etc.

It thus can be seen that only the wireless transmission device 10 needs to be installed on or connected to the existing display object during modification for the existing display object, and both initialization setting and installation are relatively simple, thus saving investment cost.

During actual setting, the initialization setting button 14 may be arranged on the housing of the wireless transmission device 10, the wireless transmission unit 16, the storage unit 20, and the processing unit 18 are arranged within the wireless transmission device 10, the power supply interface 12 is arranged at one side of the housing of the wireless transmission device 10, and a fixing structure may be arranged on the housing of the wireless transmission device 10 in order to facilitate the fixation of the wireless transmission device 10 on the display object.

In addition, in order to store the identification, orientation and/or predetermined viewable angle of the display objects more simply and conveniently, the identification, orientation and/or predetermined viewable angle of each display object can be described by a dedicated naming rule and stored in the storage unit 20. In this case, the wireless transmission device 10 constantly or regularly transmits the identification, orientation, and/or predetermined viewable angle described by a dedicated naming rule.

To further improve the interaction effect, the wireless transmission unit 16 is further connected with a control unit in the display object. The mobile terminal sends information to and receives information from the display object via the wireless transmission unit 16 and the control unit. Thus the mobile terminal, after acquiring corresponding data information, can perform information interaction with the display object via the corresponding wireless transmission device 10 according to the acquired data information, which improves the interaction effect of the display object.

In addition, the utility model may also comprise an indicator light 22 connected with the output end of the power supply interface 12, where the control end of the indicator light 22 is connected with the processing unit 18, and the processing unit 18 controls the working state of the indicator light 22 after receiving the initialization signal. For example, after the initialization setting button 14 is pressed, the indicator light 22 is always on during initialization, and flashes after initialization, which indicates successful initialization. Prompts regarding initialization setting can be given by the change of the working status of the indicator light 22, thus reminding a user of installation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wireless transmission device, characterized in that: the wireless transmission device is arranged inside a display object or connected with the display object, the display object showing advertisements to viewers, and comprises a power supply interface, an initialization setting button, a wireless transmission unit, a processing unit, and a storage unit;

an input end of the power supply interface is connected with a power supply end of the display object, an output end of the power supply interface is connected with the wireless transmission unit and the processing unit respectively, and the initialization setting button and the storage unit are connected with the processing unit respectively;

a unique identification assigned to the display object is stored in the storage unit; an initialization signal is input to the processing unit by pressing the initialization setting button, the processing unit communicates with a mobile terminal via the wireless transmission unit to set an orientation and/or predetermined viewable angle of the display object and store the orientation and/or the predetermined viewable angle in the storage unit respectively, wherein after the mobile terminal acquires the orientation and/or the predetermined viewable angle of the display object, the mobile terminal forms a sector area at the predetermined viewable angle spreading to left and right sides by taking an orientation of the mobile terminal as a central axis, wherein the sector area serves as a sensing area of the mobile terminal, and when the mobile terminal determines that the display object is located within the sensing area of the mobile terminal according to the orientation of the display object, the mobile terminal acquires data from the storage unit according to the identification of the display object; and the processing unit transmits out the identification, orientation and/or predetermined viewable angle of the display object regularly via the wireless transmission unit.

2. The wireless transmission device according to claim 1, characterized in that: the wireless transmission device further comprises an indicator lamp connected with the output end of the power supply interface, a control end of the indicator lamp is connected with the processing unit, and the processing unit controls a working state of the indicator lamp after receiving the initialization signal.

3. The wireless transmission device according to claim 2, characterized in that: the identification, orientation, and/or predetermined viewable angle are described by a service set identification (SSID) using a specific naming rule.

4. The wireless transmission device according to claim 1, characterized in that: the identification, orientation, and/or predetermined viewable angle are described by a service set identification (SSID) using a specific naming rule.

5. The wireless transmission device according to claim 1, characterized in that: the wireless transmission unit is further connected with a control unit in the display object, and the mobile terminal is in information interaction with the display object via the wireless transmission unit and the control unit.

* * * * *